US011313068B2

(12) United States Patent
Huang et al.

(10) Patent No.: US 11,313,068 B2
(45) Date of Patent: Apr. 26, 2022

(54) CLOTHING TREATMENT AGENT DISPENSING ASSEMBLY FOR CLOTHING TREATMENT APPARATUS, AND CLOTHING TREATMENT APPARATUS

(71) Applicants: QINGDAO HAIER DRUM WASHING MACHINE CO., LTD., Qingdao (CN); Haier Smart Home Co., Ltd., Qingdao (CN)

(72) Inventors: Tao Huang, Qingdao (CN); Baozhen Cheng, Qingdao (CN); Huacheng Zhang, Qingdao (CN)

(73) Assignees: QINGDAO HAIER DRUM WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 0 days.

(21) Appl. No.: 17/049,167

(22) PCT Filed: Apr. 11, 2019

(86) PCT No.: PCT/CN2019/082243

§ 371 (c)(1),
(2) Date: Oct. 20, 2020

(87) PCT Pub. No.: WO2019/201150

PCT Pub. Date: Oct. 24, 2019

(65) Prior Publication Data

US 2021/0246597 A1 Aug. 12, 2021

(30) Foreign Application Priority Data

Apr. 20, 2018 (CN) ..... 201810360732.X

(51) Int. Cl.
*D06F 39/02* (2006.01)

(52) U.S. Cl.
CPC ..... *D06F 39/022* (2013.01)

(58) Field of Classification Search
CPC ..... D06F 39/022
(Continued)

(56) References Cited

U.S. PATENT DOCUMENTS

2016/0153133 A1* 6/2016 Del Pos ..... D06F 39/02 68/12.18

FOREIGN PATENT DOCUMENTS

CN 103603172 A 2/2014
CN 103806256 A 5/2014
(Continued)

OTHER PUBLICATIONS

CN203878372U—machine translation (Year: 2014).*
International Search Report dated Jun. 28, 2019 in corresponding International application No. PCT/CN2019/082243; 6 pages.

*Primary Examiner* — Tinsae B Ayalew
(74) *Attorney, Agent, or Firm* — Maier & Maier, PLLC

(57) ABSTRACT

A clothes treating agent dispensing assembly for a clothes treatment device and a clothes treatment device including a body; the clothes treating agent dispensing assembly including a dispensing container, a storage container and a docking mechanism. The dispensing container and the storage container are both in sliding connection with the body; the docking mechanism can engage the dispensing container and the storage container with each other and cause the dispensing container and the storage container to stably slide relative to the body as a whole. The docking mechanism can engage the dispensing container and the storage container with each other and avoid relative movement of the dispensing container and the storage container, so the relative stability of the dispensing container and the storage container is maintained when a drawer is moved, and the
(Continued)

dispensing container and the storage container both can slide stably relative to the body.

7 Claims, 3 Drawing Sheets

(58) Field of Classification Search
USPC ..... 68/17 R
See application file for complete search history.

(56) References Cited

FOREIGN PATENT DOCUMENTS

| | | | |
|---|---|---|---|
| CN | 203878372 | U | 10/2014 |
| CN | 204039768 | U | 12/2014 |
| CN | 104674511 | A | 6/2015 |
| CN | 107354679 | A | 11/2017 |
| CN | 208266488 | U | 12/2018 |
| JP | 2006198292 | A | 8/2006 |

* cited by examiner

CLOTHING TREATMENT AGENT DISPENSING ASSEMBLY FOR CLOTHING TREATMENT APPARATUS, AND CLOTHING TREATMENT APPARATUS

FIELD

The present disclosure belongs to the technical field of clothing treatment, and specifically provides a clothing treatment agent dispensing assembly for use in a clothing treatment device, and a clothing treatment device.

BACKGROUND

A clothing treatment device is a machine capable of washing, spin-drying, dry cleaning and/or drying clothing. Commonly seen clothing treatment devices include washing machines, shoe washers, clothing dryers, dry cleaning machines, and washer-dryer integrated machines. Taking a washing machine as an example, in order to ensure the washing effect of clothing, detergent/washing powder is often added into the water before the clothing is washed, so as to use surfactants to clean stains and/or oil stains on the clothing.

In the related art, a washing machine is usually provided with a detergent dispensing assembly, through which the detergent/washing powder can be injected into a washing cavity of the washing machine. The detergent dispensing assembly is typically of a drawer type, which includes a dispensing box and a storage box that are integrally formed. That is, the dispensing box and the storage box constitute a drawer. The disadvantage of this structure is that when the detergent needs to be added, the drawer is pulled out first as a whole, and then the detergent is poured, which makes it necessary to provide an opening that fits the entire drawer on a panel of the washing machine. Since the overall size of the drawer is larger, the opening on the panel is also larger, which makes the washing machine have limitations in the overall spatial arrangement. For example, in order to ensure the beauty and consistency of the washing machine, a control panel of the washing machine needs to be set at the same height as the above-mentioned opening so that the overall size of the control panel of the washing machine is also made larger, which not only increases the manufacturing cost, but also is not advantageous for the overall aesthetics of the washing machine. Therefore, in practical applications, a dispensing box and a storage box that are of a split type may be used, but the use of a split structure will cause a loose connection between the dispensing box and the storage box, and the dispensing box and the storage box may be easily separated from each other during repeated pulling, further causing damage to the detergent dispensing assembly.

Accordingly, there is a need in the art for a new clothing treatment agent dispensing assembly for use in a clothing treatment device as well as a corresponding clothing treatment device to solve the above problems.

SUMMARY

In order to solve the above-mentioned problems in the related art, that is, to solve the problem that the split-type clothing treatment agent dispensing assembly in existing clothing treatment devices has a poor connection reliability and stability, the present disclosure provides a clothing treatment agent dispensing assembly for use in a clothing treatment device. The clothing treatment device includes a body, and the clothing treatment agent dispensing assembly includes a dispensing container, a storage container and a docking mechanism. The dispensing container and the storage container are both slidingly connected to the body. The docking mechanism enables the dispensing container and the storage container to be engaged with each other, and enables the dispensing container and the storage container to slide stably relative to the body as a whole.

In a preferred technical solution of the above clothing treatment agent dispensing assembly, the docking mechanism includes a first docking portion provided on the dispensing container and a second docking portion provided on the storage container, and the first docking portion and the second docking portion cooperate with each other to engage the dispensing container with the storage container.

In a preferred technical solution of the above clothing treatment agent dispensing assembly, the first docking portion is a pin hole, and the second docking portion is a positioning pin matching the pin hole.

In a preferred technical solution of the above clothing treatment agent dispensing assembly, the first docking portion is a positioning pin, and the second docking portion is a pin hole matching the positioning pin.

In a preferred technical solution of the above clothing treatment agent dispensing assembly, the first docking portion is fixedly connected to or integrated with the dispensing container.

In a preferred technical solution of the above clothing treatment agent dispensing assembly, the second docking portion is fixedly connected to or integrated with the storage container.

In a preferred technical solution of the above clothing treatment agent dispensing assembly, the number of the first docking portion and the number of the second docking portion are both two, wherein the first docking portions correspond to the second docking portions in a one-to-one correspondence, the two first docking portions are respectively disposed on both sides of a rear portion of the dispensing container, and the two second docking portions are respectively disposed on both sides of a front portion of the storage container.

In a preferred technical solution of the above clothing treatment agent dispensing assembly, the dispensing container is provided with a liquid outlet connector, the storage container is provided with a liquid inlet connector, and the liquid outlet connector and the liquid inlet connector are sealed by a sealing ring and are insertedly connected.

In a preferred technical solution of the above clothing treatment agent dispensing assembly, the sealing ring is configured as a barbed structure to prevent the dispensing container and the storage container from being separated from each other.

In another aspect, the present disclosure also provides a clothing treatment device, which includes the clothing treatment agent dispensing assembly described above.

Those skilled in the art can understand that in the preferred technical solution of the present disclosure, by providing a docking mechanism in the clothing treatment agent dispensing assembly, the dispensing container and the storage container can be docked and engaged with each other and a relative displacement between the dispensing container and the storage container is avoided, so that a relative stability of the dispensing container and the storage container is maintained during the pulling process of the drawer (that is, the combination of the dispensing container and the storage container), thus enabling both the dispensing container and the storage container to slide stably relative to the body. Moreover, the docking mechanism can improve the connection reliability of the dispensing container and the storage container to a certain extent, so that the dispensing container and the storage container can slide relative to the body as a whole.

Further, a structure in which a positioning pin matches a pin hole are adopted for the first docking portion and the second docking portion, namely, the dispensing container and the storage container can be installed by way of insertion positioning, thereby improving the stability of the movement of the dispensing container and the storage container. That is, the cooperation of the positioning pin and the pin hole can restrict a displacement of the dispensing container and the storage container in a direction perpendicular to the moving direction thereof, so that the relative stability of the dispensing container and the storage container is made higher, and the pulling operation on the drawer is made smoother and more stable.

Furthermore, a first docking portion is provided on both sides of the rear portion of the dispensing container respectively, and a second docking portion is provided on both sides of the front portion of the storage container respectively. Through the docking cooperation of the first docking portions and the second docking portions, both sides of the dispensing container and both sides of the storage container can be docked respectively, thereby improving the docking strength of the dispensing container and the storage container from both sides, so that the dispensing container and the storage container can both move relative to the body more smoothly, stably and reliably.

Still further, the dispensing container and the storage container are sealed by a sealing ring and are insertedly connected, so that the dispensing container and the storage container are kept sealed during the pulling process of the drawer, which avoids leakage of the clothing treatment agent after a long time of use, thereby improving the sealing effect of the drawer.

Yet still further, the sealing ring is configured as a barbed structure, so that the sealing ring can prevent the liquid outlet connector and the liquid inlet connector from being separated from each other while sealing the liquid outlet connector and the liquid inlet connector; that is, at the same time of implementing sealing, the sealing ring can also improve the reliability of the connection between the liquid outlet connector and the liquid inlet connector, so that the dispensing container and the storage container are not easily separated from each other when the drawer is being pulled out, and the structural stability of the drawer is further improved.

In addition, due to the use of the above described clothing treatment agent dispensing assembly, the clothing treatment device further provided by the present disclosure on the basis of the above technical solution has the technical effects of the above clothing treatment agent dispensing assembly; moreover, as compared with the clothing treatment device before the improvement, the present disclosure can improve the relative stability and connection reliability of the dispensing container and the storage container in the clothing treatment agent dispensing assembly, so that both the dispensing container and the storage container can slide stably relative to the body.

BRIEF DESCRIPTION OF THE DRAWINGS

Hereinafter, preferred embodiments of the present disclosure will be described with reference to the accompanying drawings and in conjunction with a washing machine. In the drawings.

DETAILED DESCRIPTION

Figure 1:
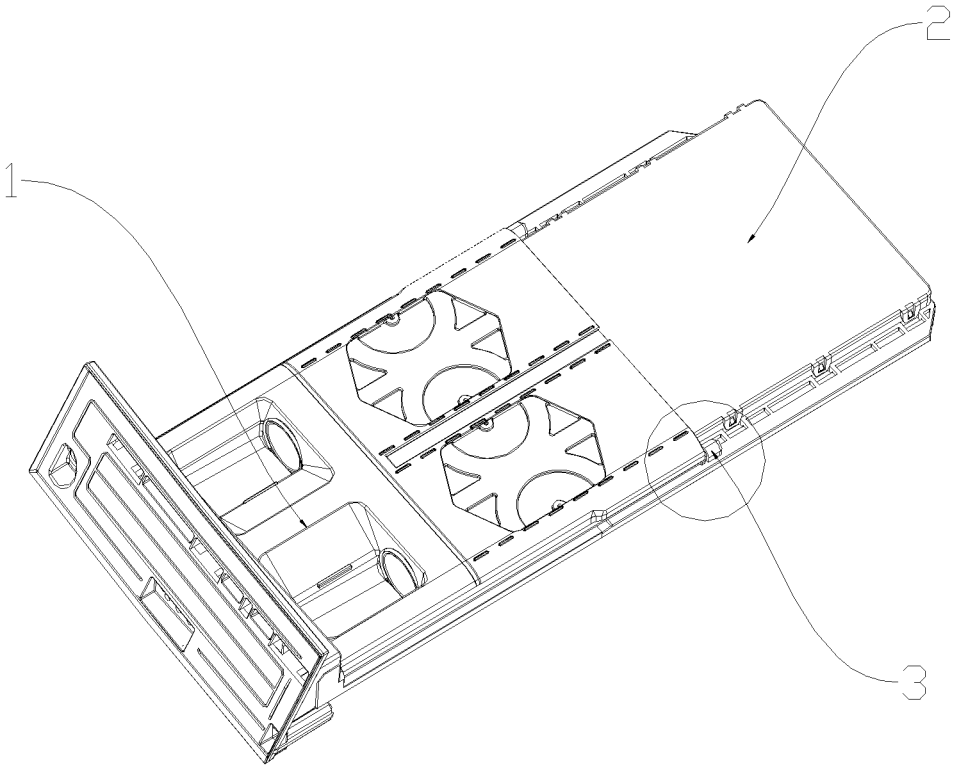
FIG. 1 is a first schematic structural view of a detergent dispensing assembly for use in a washing machine according to the present disclosure.

First, it should be understood by those skilled in the art that these embodiments are only used to explain the technical principles of the present disclosure, and are not intended to limit the scope of protection of the present disclosure. For example, although the following embodiments are explained in conjunction with a washing machine, this is not limitative. The technical solutions of the present disclosure are also applicable to other clothing treatment devices, such as air washing devices, shoe washers and washer-dryer integrated machines. Such a change to application object does not deviate from the principle and scope of the present disclosure.

It should be noted that in the description of the present disclosure, directional or positional relationships indicated by terms such as "center", "upper", "front", "rear", "left", "right", "inner" and "outer" are based on the directional or positional relationships shown in the drawings. They are merely used for the convenience of description, and do not indicate or imply that the device or element involved must have a specific orientation, or be configured or operated in a specific orientation, and therefore they should not be construed as limiting the present disclosure. In addition, terms "first" and "second" are used for descriptive purpose only, and should not be construed as indicating or implying relative importance.

In addition, it should also be noted that in the description of the present disclosure, unless otherwise clearly specified and defined, terms "dispose", "install", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be an internal communication between two elements. For those skilled in the art, the specific meaning of the above terms in the present disclosure can be understood according to specific situations.

Based on the problem pointed out in the "BACKGROUND OF THE INVENTION" that the split-type detergent dispensing assembly in existing washing machines has a poor connection reliability and stability, the present disclosure provides a detergent dispensing assembly for use in a washing machine, and a washing machine, aiming at improving the relative stability and connection reliability of the dispensing container and the storage container in the detergent dispensing assembly, so that both the dispensing container and the storage container can slide stably relative to the body.

Figure 2:
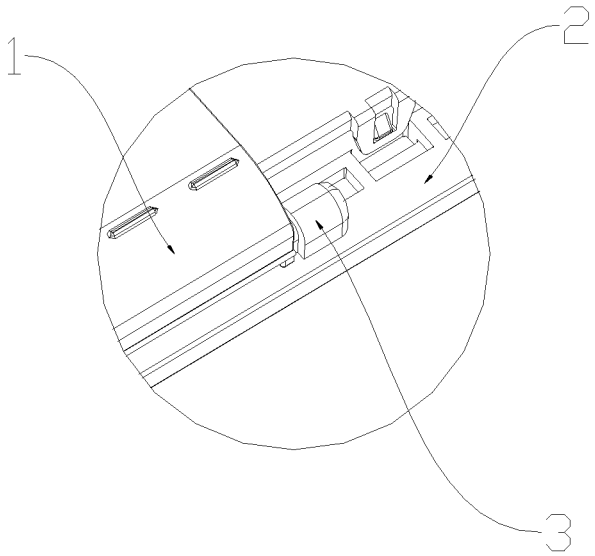
FIG. 2 is a partially enlarged view of FIG. 1.
Figure 3:
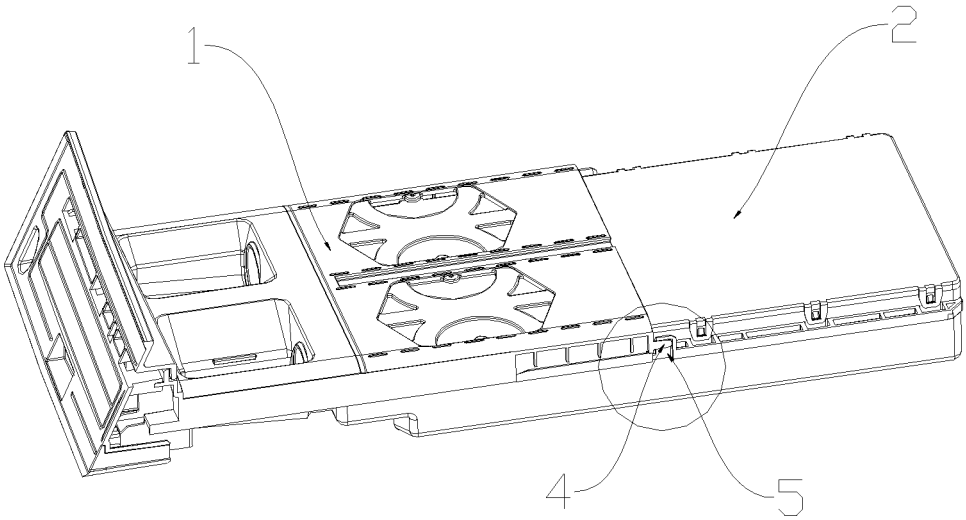
FIG. 3 is a schematic cross-sectional view of a detergent dispensing assembly for use in a washing machine according to the present disclosure.
Figure 4:
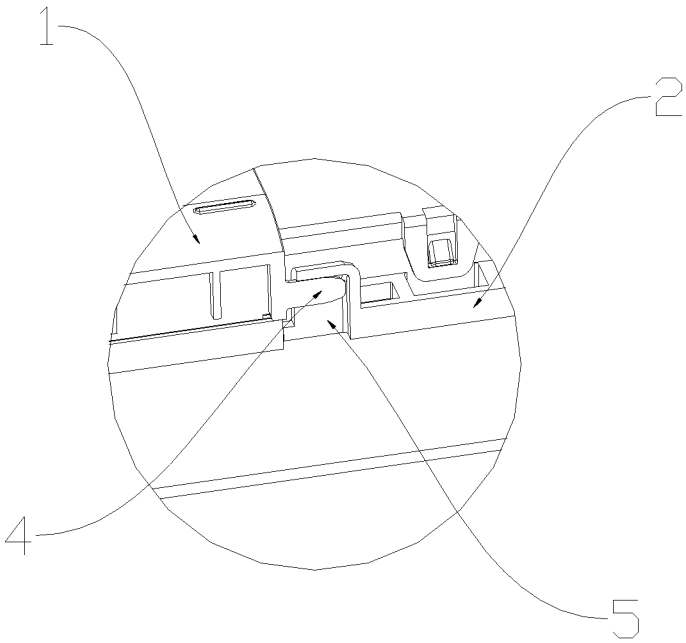
FIG. 4 is a partially enlarged view of FIG. 3.

Specifically, as shown in FIGS. 1 and 2, the washing machine of the present disclosure includes a body and a dispensing mechanism fixedly connected to or integrated with the body. The clothing treatment agent dispensing assembly includes a dispensing container 1, a storage container 2 and a docking mechanism 3. Both the dispensing container 1 and the storage container 2 are slidingly connected with the dispensing mechanism on the body. The docking mechanism 3 enables the dispensing container 1 and the storage container 2 to be engaged with each other, and enables the dispensing container 1 and the storage container 2 to slide stably relative to the body as a whole. The docking mechanism 3 may be disposed on the dispensing container 1, or on the storage container 2, or on the dispensing mechanism; alternatively, a part of the docking mechanism 3 is disposed on the dispensing container 1, and the other part of the docking mechanism 3 is disposed on the storage container 2. Those skilled in the art may flexibly set the arrangement position of the docking mechanism 3 in practical applications, as long as the docking mechanism 3 enables the dispensing container 1 and the storage container 2 to be docked and engaged with each other, and enables the dispensing container 1 and the storage container 2 to slide relative to the body as a whole. Such a change to the arrangement position of the docking mechanism 3 does not deviate from the principle and scope of the present disclosure, and should be covered within the scope of protection of the present disclosure.

Preferably, the docking mechanism 3 includes a first docking portion provided on the dispensing container 1 and a second docking portion provided on the storage container 2, and the first docking portion and the second docking portion cooperate with each other to engage the dispensing container 1 with the storage container 2. For the first docking portion and the second docking portion, the cooperation mode of a positioning pin 4 and a pin hole 5 may be adopted, or the cooperation mode of a claw and a slot may be adopted, or the cooperation mode using a buckle may be adopted. Those skilled in the art may flexibly set the specific structure and cooperation mode of the docking mechanism 3 in practical applications, as long as the docking mechanism 3 enables the dispensing container 1 and the storage container 2 to be docked and engaged with each other, and enables the dispensing container 1 and the storage container 2 to slide relative to the body as a whole. Such a change to the specific structure and cooperation mode of the docking mechanism 3 does not deviate from the principle and scope of the present disclosure, and should be covered within the scope of protection of the present disclosure.

Preferably, with continued reference to FIGS. 1 to 4, the first docking portion is a positioning pin 4, and the second docking portion is a pin hole 5 that matches the positioning pin 4. That is, the positioning pin 4 is provided on the dispensing container 1, and the pin hole 5 that matches the positioning pin 4 is provided on the storage container 2, so that the dispensing container 1 and the storage container 2 are docked, and the dispensing container 1 and the storage container 2 will not be displaced in a direction perpendicular to the moving direction thereof. Of course, as a modification to the above embodiment, the first docking portion is a pin hole 5, and the second docking portion is a positioning pin 4 that matches the pin hole 5. That is, the pin hole 5 is provided on the dispensing container 1, and the positioning pin 4 that matches the pin hole 5 is provided on the storage container 2. The implementation principle of this solution is similar to the above embodiment, and will not be repeated herein. In the above embodiment, a transition fit or an interference fit is preferably adopted for the positioning pin 4 and the pin hole 5, so as to ensure that a relative movement of the dispensing container 1 and the storage container 2 can be restricted after the positioning pin 4 and the pin hole 5 are docked and that the dispensing container 1 and the storage container 2 can move stably relative to the body.

Specifically, in the above structure, the first docking portion is fixedly connected to or integrated with the dispensing container 1. The fixed connection of the first docking portion with the dispensing container 1 can facilitate the installation and disassembly of components, and the integration of the first docking portion with the dispensing container 1 facilitates one-time molding of a die. Similarly, the second docking portion is fixedly connected to or integrated with the storage container 2. The fixed connection of the second docking portion with the storage container 2 can facilitate the installation and disassembly of components, and the integration of the second docking portion with the storage container 2 facilitates one-time molding of a die.

Further preferably, the number of the first docking portion and the number of the second docking portion are both two, wherein the first docking portions correspond to the second docking portions in a one-to-one correspondence, the two first docking portions are respectively disposed on both sides of a rear portion of the dispensing container 1, and the two second docking portions are respectively disposed on both sides of a front portion of the storage container 2. In the description of the present disclosure, a side of the dispensing container 1 that faces the storage container 2 is the rear side, and a side of the storage container 2 that faces the dispensing container 1 is the front side. The dispensing container 1 is pulled out of the body toward the front side of the body, and the dispensing container 1 is pushed back into the body toward the rear side of the body. In a possible embodiment, as shown in FIGS. 1 to 4, a positioning pin 4 is provided on both sides of the rear portion of the dispensing container 1, a pin hole 5 is provided on both sides of the front portion of the storage container 2, and the positioning pins 4 correspond to the pin holes 5 in a one-to-one correspondence and match each other by inserted connection, so that the left and right sides of the dispensing container 1 and the left and right sides of the storage container 2 can each be docked and matched with each other, thereby improving the relative stability of the dispensing container 1 and the storage container 2, so that both the dispensing container 1 and the storage container 2 can move stably.

Figure 5:
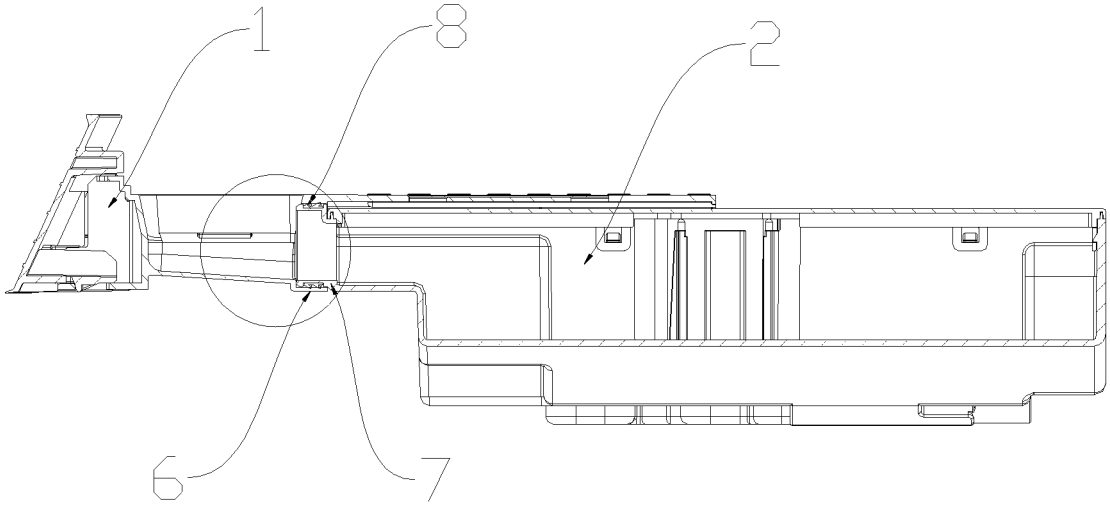
FIG. 5 is a second schematic structural view of a detergent dispensing assembly for use in a washing machine according to the present disclosure.
Figure 6:
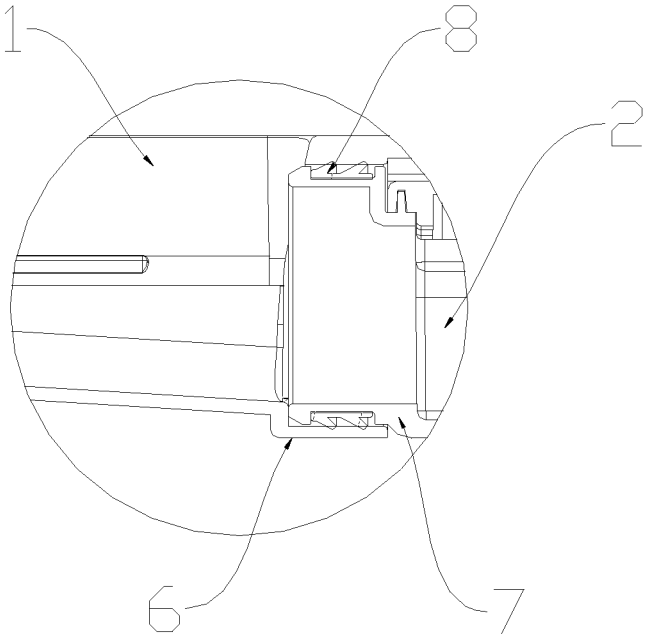
FIG. 6 is a partially enlarged view of FIG. 5.

Preferably, as shown in FIGS. 5 and 6, the dispensing container 1 is provided with a liquid outlet connector 6, the storage container 2 is provided with a liquid inlet connector 7, and the liquid outlet connector 6 and the liquid inlet connector 7 are sealed by a sealing ring 8 and are insertedly connected. The liquid outlet connector 6 may be fixedly connected to or integrated with the dispensing container 1, and the liquid inlet connector 7 may be fixedly connected to or integrated with the storage container 2. In a possible embodiment, an inner diameter of the liquid outlet connector 6 is greater than or equal to an outer diameter of the liquid inlet connector 7, and the liquid inlet connector 7 is inserted into the liquid outlet connector 6 in an assembled state. Of course, in another possible embodiment, an inner diameter of the liquid inlet connector 7 is greater than or equal to an outer diameter of the liquid outlet connector 6, and the liquid outlet connector 6 is inserted into the liquid inlet connector 7 in the assembled state. Those skilled in the art may flexibly set the size of the liquid outlet connector 6 and the size of the liquid inlet connector 7 in practical applications, as long as the liquid outlet connector 6 can be connected to the liquid inlet connector 7, and the liquid outlet connector 6 and the liquid inlet connector 7 can be sealed by the sealing ring 8.

Further preferably, the sealing ring 8 is configured as a barbed structure to prevent the liquid outlet connector 6 and the liquid inlet connector 7 from being separated from each other. As shown in FIGS. 5 and 6, the barbed structure is arranged obliquely; specifically, it is inclinedly arranged toward the side (the rear side) of the dispensing container 1 that faces the storage container 2, so that the liquid outlet connector 6 and the liquid inlet connector 7 can be smoothly installed by inserted connection. However, after the installation by inserted connection is completed, the liquid outlet connector 6 and the liquid inlet connector 7 can be prevented from moving away from each other, so as to improve the connection reliability of the liquid outlet connector 6 and the liquid inlet connector 7.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principle of the present disclosure, those skilled in the art can make equivalent changes or replacements to relevant technical features, and the technical solutions after these changes or replacements will fall within the scope of protection of the present disclosure.

What is claimed is:

1. A clothing treatment agent dispensing assembly for use in a clothing treatment device, the clothing treatment agent dispensing assembly comprising a dispensing container, a storage container and a docking mechanism; wherein both the dispensing container and the storage container are configured to be slidingly connected to the clothing treatment device, and wherein the docking mechanism enables the dispensing container and the storage container to be engaged with each other, and enables the dispensing container and the storage container to slide stably relative to the clothing treatment device as a whole, wherein the docking mechanism comprises a first docking portion provided on the dispensing container and a second docking portion provided on the storage container, and the first docking portion and the second docking portion cooperate with each other to engage the dispensing container with the storage container; and wherein the first docking portion is a pin hole, and the second docking portion is a positioning pin matching the pin hole; or the first docking portion is a positioning pin, and the second docking portion is a pin hole matching the positioning pin.

2. The clothing treatment agent dispensing assembly according to claim 1, wherein the first docking portion is fixedly connected to or integrated with the dispensing container.

3. The clothing treatment agent dispensing assembly according to claim 1, wherein the second docking portion is fixedly connected to or integrated with the storage container.

4. The clothing treatment agent dispensing assembly according to claim 1, wherein the number of the first docking portion and the number of the second docking portion are both two, and wherein the first docking portions correspond to the second docking portions in a one-to-one correspondence, the two first docking portions are respectively disposed on both sides of a rear portion of the dispensing container, and the two second docking portions are respectively disposed on both sides of a front portion of the storage container.

5. The clothing treatment agent dispensing according to claim 1, wherein the dispensing container is provided with a liquid outlet connector, the storage container is provided with a liquid inlet connector, and the liquid outlet connector and the liquid inlet connector are sealed by a sealing ring and are insertedly connected.

6. The clothing treatment agent dispensing assembly according to claim 5, wherein the sealing ring is configured as a barbed structure to prevent the dispensing container and the storage container from being separated from each other.

7. A clothing treatment device, comprising the clothing treatment agent dispensing assembly according to claim 1.

* * * * *